United States Patent [19]

Bauer

[11] 4,347,953

[45] Sep. 7, 1982

[54] ELASTOMER BULB DISPENSING PUMP

[76] Inventor: Peter Bauer, 13921 Esworthy Rd., Germantown, Md. 20767

[21] Appl. No.: 154,607

[22] Filed: May 30, 1980

[51] Int. Cl.[3] ..... B65D 37/00; B05B 11/00

[52] U.S. Cl. ..... 222/207; 222/214; 222/383; 222/321; 417/479

[58] Field of Search ..... 417/479; 222/207, 211, 222/213, 214, 383, 321

[56] References Cited

U.S. PATENT DOCUMENTS

| | | | |
|---|---|---|---|
| 3,029,742 | 4/1962 | Curtis | 222/207 X |
| 3,387,789 | 6/1968 | Fedit et al. | 222/321 X |
| 3,726,442 | 4/1973 | Davidson et al. | 222/207 |
| 4,088,248 | 5/1978 | Blake | 222/207 |

*Primary Examiner*—David A. Scherbel

*Attorney, Agent, or Firm*—Griffin, Branigan & Butler

[57] ABSTRACT

A dispensing pump is characterized by an elastomer bulb configured as a cup and having a tubular neck portion extending from its base. The cup portion is inverted in a pump housing with the neck extending upwardly from the center of the cup base into a stem member where it concentrically and resiliently engages a nipple. The rim of the cup portion is positioned to overlie a dip tube inlet into the housing. In its quiescent position the bulb is slightly longitudinally compressed by forcing the stem, neck and center of the cup portion into the bulb chamber, thereby forming a convolution at the periphery of the cup base. The convolution provides a positive seal of a vent passage which is open only during pump actuation. Actuation is effected by pushing the stem further into the cup, which action is aided by a spring snapping effect in the bulb, thereby forcing fluid from the pump chamber up through the neck and around the nipple. Relaxation of the stem permits the spring action to restore the bulb to its quiescent state while the cup rim is drawn into the chamber to unblock the dip tube and draw fluid into the chamber.

9 Claims, 4 Drawing Figures

ELASTOMER BULB DISPENSING PUMP

TECHNICAL FIELD

The present invention relates to dispensing pumps of the type wherein a resiliently deformable diaphragm member is selectively compressed and released in order to discharge fluid contents from a container.

BACKGROUND ART

It is well known in the field of hand operated dispensing pumps to utilize a resiliently deformable bulbous diaphragm which cooperates with the pump housing to define a pump chamber. Such a diaphragm typically performs three valving functions, namely: controlling inflow of fluid from a container to the pump chamber; controlling outflow of fluid from the pump chamber; and venting the space in the container above the fluid contents during inflow of fluid to the pump chamber. Inflow and outflow of fluid to and from the pump chamber is generally controlled by lip or flange portions of the diaphragm which cooperate with passages in the pump housing in a flapper valve configuration. Venting control is sometimes achieved by positioning the main bulbous diaphragm body portion to close a vent passage in the pump housing except during pump operation, although alternative venting schemes have been used. Examples of this type of prior art pump may be found in U.S. Pat. Nos. 3,726,442 (Davidson et al), 3,986,644 (Grogan et al), 3,987,938 (Cooprider et al), 3,995,774 (Cooprider et al), 4,199,083 (LoMaglio).

Pumps of the type described above suffer from certain practical disadvantages. One such disadvantages resides in the fact that the outlet flapper valve closure, when the pump is in use, is formed by a diaphragm lip or flange in a relaxed or unstressed state. The closure is therefore not positively sealed and leakage from the pump chamber is possible, particularly if the container is tipped over and, more particularly, in the case of low viscosity fluids. A further disadvantage of prior art pumps of this type resides in the fact that a considerable portion of the fluid in the pump chamber is not expelled during a chamber compression stroke, primarily because of the difficulty and/or inconvenience involved in fully compressing the diaphragm. Another disadvantage of these prior art pumps is that the diaphragm is exposed to the ambient environment and thereby subject to inadvertent rupture if the pump/container assembly is carelessly handled or mishandled. A still further disadvantage relates to the fact that these prior art pumps generally require six independent parts to be fabricated and assembled to form the pump. It is desirable to reduce the number of parts in order to reduce the cost and assembly complexity of the pump; in fact, an attempt at reducing the number of parts is found in the aforesaid Cooprider et al U.S. Pat. No. 3,987,938. However, part reduction is achieved in that patent at the expense of increased assembly complexity and cost (i.e. it is necessary to perform a swaging operation to secure the diaphragm in place) and parts complexity (i.e. the diaphragm is provided with three independently depending annular flanges of different diameter).

SUMMARY OF THE INVENTION

It is an object of the present invention to provide a dispensing pump of the type described which is devoid of the disadvantages stated above. More particularly, it is an object of the present invention to provide such a pump wherein the outlet flapper valve formed by the diaphragm is positively sealed, wherein actuation is facilitated to thereby maximize the amount of fluid expelled during a given pump stroke, wherein the diaphragm is protected against inadvertent rupture, and wherein a minimum number of parts are required without sacrificing simplicity of part fabrication and assembly.

In accordance with the present invention an elastomer bulb is formed as a cup having a U-shaped longitudinal cross-section and having a tubular neck member projecting from its closed end. The bulb is placed in a housing with its open end facing downward to form a pump chamber and with its neck received in a hollow stem member. The upper end of the neck resiliently engages a nipple in the stem. The stem is positioned to partially compress the bulb such that the center of the closed end of the bulb is forced longitudinally downward in the non-actuated position of the pump. This produces a convolution in the peripheral portion of the closed end of the bulb, this convolution bulging outward against the housing to provide an annular seal. A vent passage in the housing is thereby blocked but is opened when the pump is actuated. The lower lip or rim of the bulb forms a flapper valve which positively seals a dip tube due to the quiescent compression of the bulb. The pump is actuated by forcing the stem down to thereby further convolute the closed end of the bulb while pressurizing the fluid contents in the chamber. The pressurized fluid is forced up through the neck and out around the nipple where it is dispensed to the ambient environment. The pressurization of the pump chamber enhances the sealing of the dip tube by the bulb rim. During the downward pump stroke the bulb experiences a sort of snapping effect which aids the downward stroke. This snapping effect is produced by the elastic spring action of the bulb as the convolution passes the point beyond which it resists further convoluting. This effect aids the applied force in expelling the fluid contents of the pump chamber.

After actuation, upon release of the stem the elasticity of the bulb forces the stem back upward until the bulb is restored to its quiescent position. During this return stroke the pressure in the pump chamber is reduced forcing the tube neck to seal about the nipple but removing the bulb rim from the dip tube so that fluid from the container can be aspirated into the pump chamber.

In one embodiment the pump is fabricated from only three relatively simple parts.

BRIEF DESCRIPTION OF THE DRAWINGS

The above and still further objects, features and advantages of the present invention will become apparent upon consideration of the following detailed description of a plurality of embodiments thereof, especially when taken in conjunction with the accompanying drawings, wherein.

DESCRIPTION OF THE PREFERRED EMBODIMENTS

Figure 1:
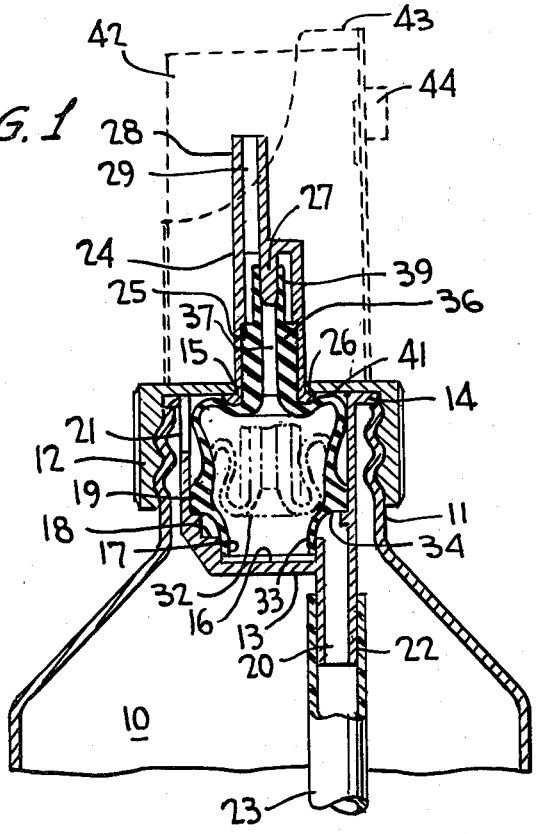
FIG. 1 is a side view in section of one embodiment of the pump of the present invention.

Referring to FIG. 1 of the accompanying drawings in greater detail, a container 10 has its upper portion shown and, for example, may be a bottle made of glass, plastic or other suitable material. The neck 11 of the container is threaded and sealed with a mating threaded cap 12 which has a central circular hole extending through its top wall. A pump housing member 13 is preferably made of a thermoplastic material such as polypropylene and is configured in the general shape of a cup having an annular lip 14 extending radially from its rim. Lip 14 is adapted to be engaged between the top of the bottle neck 11 and the underside of the top wall of the cap 12 so that housing member 13 can be suspended inside the bottle neck with a small annular space between the neck and housing member.

The interior of housing member includes a flat circular bottom wall 16 bordered by an upwardly diverging frusto-conical wall 17. Wall 17 terminates in a flat annular shoulder 18 which is parallel to bottom wall 17. At the outer edge of shoulder 18 there is a perpendicular wall which terminates in another annular shoulder 19. The peripheral wall of housing member 13 extends upwardly from the outer edge of shoulder 19 and includes one or more slots 21 defined therethrough. A tube-like projection 22, integral with the housing member, extends downwardly from the bottom of the housing member and is provided with a longitudinal bore 20 which terminates at annular shoulder 18. Projection 22 may itself serve as a dip tube whereby it extends to the bottom of container 10; or, as shown, it may fit concentrically into a tube 23 which serves that function.

A housing stem 24 is in the form of an inverted cup having a considerably smaller diameter than that of housing member 13. Housing stem 24 is also made of thermoplastic material such as polypropylene and is slidably engaged in the central hole formed in cap 12 in such a way to permit longitudinal movement of the stem into housing member 13. An annular lip or shoulder 26 projects radially outward from the rim of stem 24 to a diameter greater than that of the hole in cap 12. Shoulder 26 thereby serves as a stop against the underside of the top wall of the cap to prevent removal of stem 24 when it is moved upward. A downwardly facing shoulder 25 is defined in the interior wall of the hollow stem 24. A nipple 27 projects from the base of the stem cup configuration into the interior of cup volume. A tube-like projection 28 having a longitudinal bore 29 defined therethrough projects upwardly from the top of the stem. Bore 29 serves as an outlet passage for the pump. One or more notches 15 provided in the cap through-hole to provide vent communication through the cap 12; alternatively, notches may be provided along the outside of stem 24 for this purpose.

Figure 2:
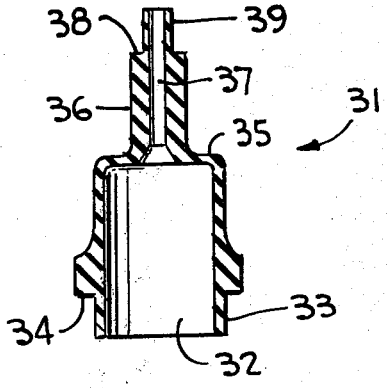
FIG. 2 is a view in section of the elastomer bulb, used in the pump of FIG. 1, in an unstressed condition.

The heart of the pump is an elastomer bulb 31 shown separately in FIG. 2. Bulb 31 is made from an elastic, flexible, springy material such as rubber. The bulb includes an inverted cup-shaped portion 32 having a somewhat smaller outside diameter than the inner diameter of housing member 13 and having a depth which is greater than the depth of housing member 13. The annular wall portion 33 of the bulb proximate the rim is relatively thin to permit it to readily flex in response to pressure conditions within the bulb. Just above this thin-walled portion 33 there is provided an annular step or shoulder 34 which projects radially outward. Beyond shoulder 34 the wall thickness tapers gradually toward the base 35 of cup portion 32. A tube-like neck projection 36 extends upwardly from the base 35 and is provided with a longitudinal bore 37 communicating with the interior of cup portion 32. The peripheral wall of neck 36 includes an annular upwardly facing step 38 beyond which the neck wall terminates in a relatively thin-walled spout 39.

The bulb 31 is inserted into the pump, as seen in FIG. 1, by removing cap 12 and stem 24 from the container and inserting neck 36 of the bulb into the step 24 until annular shoulder 25 of the stem abuts annular shoulder 38 of the bulb. In this position, spout 39 envelops nipple 27 in a resilient sealing engagement. Cap 12 is then screwed onto the container neck 11 whereby bulb 31 is forced into housing member 13 until annular shoulder 34 of the bulb abuts annular shoulder 19 of the housing member. In this position bulb 31 is partially compressed lengthwise, forcing the walls of the bulb to spread outwardly and upwardly whereby a small convolution 41 is formed at the bulb base 35 surrounding neck 36. Convolution 41 presses against the cap interior to effect a seal between vent slots 21 and vent notches 15. This isolates the bottle contents from ambient and precludes the spilling of the contents should the bottle 10 tip and fall. In addition, resilient lip 33 of the bulb is positively urged against frusto-conical wall section 17 of the housing member to seal the annular region defined between lip 33, shoulder 18 and wall 19 from the bulb interior. This isolates dip tube bore 20 from the bulb interior.

Actuation of the pump is achieved by pushing stem 24 down through cap 12 into the housing member 13. A partially actuated position is illustrated in phantom lines in FIG. 1. Downward movement of the stem into the housing member increases the pressure in the pump chamber, thereby producing two primary effects. One effect is that lip 33 of the bulb is more positively urged against surface 17 to prevent the chamber contents from being forced back into container 10 via the dip tube. The other effect is to force the fluid contents of the cup through the bore 37 in neck 36 where it expands spout 39 to permit passage of the fluid around nipple 27. The fluid thus forced around the nipple is directed through bore 29 from which it is dispensed. In this respect a conventional push button 42, push button support assembly 43 and nozzle 44 may be provided as illustrated in phantom lines in FIG. 1.

During the downward stroke of the stem 24, the bulb 31 experiences a snapping effect which aids in the downward movement of the stem. Specifically, the bulb initially elastically resists further compression until a certain point of convolution is reached. At that point a negative spring rate effect causes the bulb to snap, aiding the downward force and greatly facilitating further compression of the pump chamber. In this manner a more complete expulsion of the chamber contents is achieved with lesser applied force than is the case in prior art pumps of the bulbous diaphram type. The gradual reduction of the bulb wall thickness between stop 34 and base 35 serve to provide this spring rate effect while avoiding the possibility of buckling of the bulb wall.

During the actuation stroke of stem 24 the vent seal provided by convolution 41 is broken. Therefore, the region of container 10 above the fluid contents is vented, via slots 21 and notches 15, to ambient.

When the depressed stem 24 is released, the spring action in bulb 31 causes the bulb and stem to return to its quiescent position illustrated in solid lines in FIG. 1. During this return stroke a reduced pressure is experienced in the pump chamber. The reduced pressure restores the seal between spout 39 and nipple 27. In addition, the reduced pressure causes lip 33 of bulb 31 to deflect inwardly from wall 17, thereby permitting the reduced pressure to draw fluid from container 10 up through dip tube 23 and bore 20 and into the pump chamber where it remains ready to be dispensed during the next pump stroke. Venting of the container during the upstroke via slots 21 and notches 15 results in ambient pressurization of the container contents to permit the negative pump chamber pressure to draw the container fluid into the chamber.

Elastomer bulb 31, configured as described and axially compressed in its quiescent position as shown in FIG. 1, has numerous advantages. Among these are: it serves as a one-piece leak-proof pump mechanism; it has a built-in bias or return spring force for the return stroke of the pump; it provides a suction for drawing dispensing fluid into the pump chamber and an inlet check valve for controlling inflow of that fluid; it provides a compression force for expelling fluid from the pump chamber and an outlet check valve for controlling outflow of that fluid; it seals the container against leakage or spillage during non-use and controls venting of the container during pump actuation; it provides for axial alignment of the stem and guidance of the stem during actuation; it permits a smaller number of pump parts to be utilized; and it is easily molded with relatively uncomplicated molds.

Figure 3:
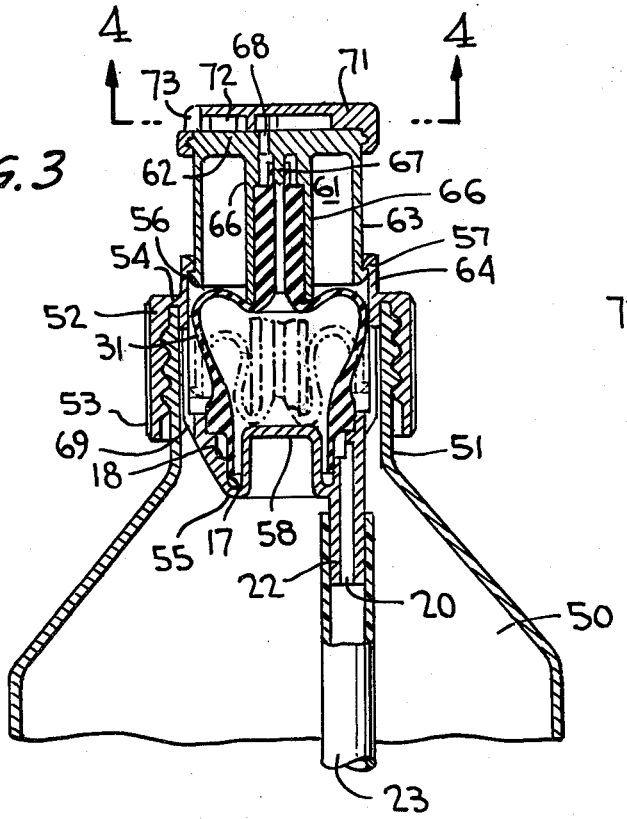
FIG. 3 is a side view in section of another pump embodiment of the present invention.
Figure 4:
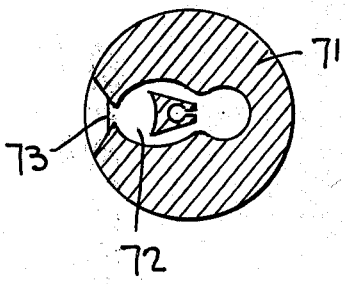
FIG. 4 is a view in section taken along lines 4—4 of FIG. 3.

With respect to minimizing the number of pump parts, it is noted that the pump mechanism of FIG. 1 includes, as necessary parts, housing member 13, cap 12, stem 24 and bulb 31, for a total of four parts. The push button 42 and housing 43 therefor are not truly part of the pump mechanism; however, if included these parts would make six total separate parts of the assembly. All of these parts are simple to mold and assemble. It is possible, however, by forming the cap 12 and housing member 13 as one unit, and by forming the stem as part of the push button housing, to have a total of only four parts. An embodiment incorporating these features is illustrated in FIGS. 3 and 4 and described in detail in the following paragraphs.

A container 50 is in the form of a bottle having neck 51. A housing-cap member 52 includes an outer cylindrical wall 53 having an interior surface which is threaded to engage mating threads on the container neck 51. The top of the cap includes a narrow annular portion 54 extending radially inward from the top of outer wall 53. The housing portion 55 of member 52 includes a cup-like part which is suspended from the radially inner edge of top wall 54. The housing portion is disposed concentrically within outer wall 53 and annularly spaced therefrom to permit the annular bottle neck 51 to be threadedly engaged by wall 53 when housing portion 55 is disposed within the neck. In addition, as part of the housing-cap member 52, a thin annular wall 56 projects upwardly a short distance from the inner edge of annular top wall 54. The top of wall 56 terminates in a short barbed ridge 57 directed radially inward. The cup-like part of housing portion 55 is similar to member 13 of FIG. 1 and like parts are similarly numbered. The main difference, and this may be used in the FIG. 1 embodiment as well, is that the bottom wall 58 of housing portion 55 is raised as a cylindrical step in the center of the housing to serve as a limit for the downward stroke of the pump. This feature can be eliminated if desired.

An actuator member 61 is in the form of an inverted cup having a circular top wall 62 and a cylindrical side wall 63. The lower lip of cylindrical wall 63 terminates in a barbed ridge 64 which projects radially outward. Cylindrical wall 63 has a diameter slightly smaller than the diameter of wall 56 of cap-housing member 52 so that actuator 61 can slide longitudinally into and out of housing portion 55. A stem 66 is integrally formed with the actuator and projects downward from top wall 62 as a cylinder coaxial with wall 63. Stem 66 is adapted to receive the neck 25 of bulb 31 in the same manner as described for stem 24 in FIG. 1. A nipple 67 projects downwardly from the top of the stem and an outlet opening 68 is defined through wall 62 within the confines of the stem.

Elastomer bulb 31 fits into stem 66 and onto nipple 67 in the manner described in relation to FIG. 1. Likewise, bulb 31 fits into housing portion 55 in the same manner described in relation to housing member 13 of FIG. 1. The main difference in the position of bulb 31 in FIG. 3 results from the fact that there is no top wall of the cap member to abut the convolution 41 for purposes of sealing the container. Instead, convolution 41 is compressed against the annular sidewall of housing portion 55 at a location proximate the top of that sidewall. Elongated slots 69 are defined in the sidewall of housing portion 55 at a location below the point at which the convolution 41 contacts that sidewall when the bulb is in its quiescent position. When the bulb is depressed, slots 69 communicate with the space above the convolution so that the container may be vented. Generally, sufficient air space is provided between the sliding engagement of actuator 61 and cap-housing member 52 to serve the venting function. If desired, slots can be provided in the sidewall of actuator 61 to enhance venting during pump actuation.

The number of parts required for the pump of FIG. 3 is three, namely: cap-housing member 52; actuator 61 and elastomeric bulb 31. If desired, an additional part may be added in the form of a cover 71 which snap fits at its edges onto the top of actuator 61. Cover 71 is a disc-like member having a fluidic oscillator 72 defined in its bottom surface. Fluidic oscillator 72 is shown as the oscillator which is the subject of my U.S. Pat. No. 4,184,636 which is expressly incorporated herein by reference; however, other fluidic oscillators may be used. Importantly, the oscillator is of the type which receives pressurized fluid and sprays it in a definable spray pattern into the ambient environment. The oscillator is formed as recesses in the bottom of cover 71 and is sealed by wall 62 of actuator 61. Outlet opening 68 in wall 62 is positioned to deliver pressurized fluid from the pump directly to the fluidic oscillator to be sprayed from oscillator outlet 73.

It is readily seen that the pump of FIG. 3 requires fewer parts than the pump of FIG. 1, although there is a tradeoff in parts complexity. The more complex parts (and resulting tooling) is offset by the lower overall costs in high quantity production applications.

While I have described and illustrated a plurality of embodiments of my invention, it will be clear that variations of the details of construction which are specifically illustrated and described may be resorted to without departing from the true spirit and scope of the invention as defined in the appended claims.

I claim:

1. A dispensing pump for dispensing fluid from a container, said pump comprising:

a housing member having a generally cup-like configuration with an open upper end and a supply tube projecting generally downward therefrom and opening into the interior of said housing member;

means securing said housing in said container with said open end facing upward in the normal orientation of said container and with said supply tube extending into the fluid in said container;

an elastomer bulb having a cup portion with a base and an annular side wall terminating in a resilient annular lip and having a tubular neck with a distal end projecting from said base away from said cup, said tubular neck including an interior passage communicating with the interior of the bulb cup, said bulb being positioned in said housing member with its cup inverted so that the bulb and housing define a variable volume pump chamber and such that the resilient lip of said bulb blocks fluid communication between said pump chamber and said supply tube;

a stem member having a generally cylindrical interior volume which receives said tubular neck and having a nipple projecting into said interior volume which is resilient engaged by the distal end of said tubular neck in fluid sealing relation, said stem further including an outlet opening for permitting outflow from said stem interior volume of fluid forced through the resilient engagement between said nipple and said distal end of said neck;

means securing said stem from longitudinal sliding movement of said stem between a quiescent position wherein the pump chamber volume is maximum an actuated position wherein the pump chambet volume is minimum, said securing means being positioned to longitudinally compress the cup portion of said bulb in said quiescent position by urging said neck into said base to form a convolution in the base of the bulb cup, the compression of said cup urging said lip outward to positively seal said supply tube; and vent means between said container and ambient wherein said convolution is positioned to block said vent means only in said quiescent position.

2. The pump according to claim 1 wherein said container has a top rim and said housing member includes a radially-extending flange which rests on the container rim to support the housing member suspended in the container, wherein said securing means includes a cap secured to the top rim of said container and engaging said flange between said cap and top rim, said cap having a top wall with an aperture defined therethrough for slidably engaging said stem.

3. The pump according to claim 2 wherein said vent means comprises:

at least one opening defined in said housing member at a location below said convolution in said bulb in said quiescent position; and a further opening defined in at least one of said cup and stem and wherein said convolution of said bulb in said quiescent position pushes resiliently against said cap to provide an annular seal which blocks fluid communication between said opening in said housing and said further opening.

4. The pump according to claim 1 wherein said container has a top and wherein said housing member is formed integral with a cap secured to said container top and includes an upstanding wall surrounding the space above said housing member;

wherein said securing means comprises an actuator member having a top wall and, extending downwardly therefrom, an outer annular wall in slidable engagement with said upstanding wall; and wherein said stem is formed integral with said actuator member and projects downwardly from said actuator member top wall within the confines of said outer annular wall.

5. The pump according to claims 1, 2, 3 or 4 wherein the interior of said housing member includes lower and upper annular upwardly facing shoulders, the lower shoulder being spaced from the bottom of the housing member interior by a slightly sloped side wall, said supply tube opening into the housing member interior at said upper shoulder, wherein said bulb includes an outwardly projecting shoulder between said base and said lip which abuts the upper housing member shoulder and wherein said lip of said bulb extends along said sloped side wall to define a region between said upper and lower shoulders and said lip wherein said lip serves as a flapper valve.

6. The pump according to claim 4 further comprising a cover member having a lower surface and a fluidic oscillator defined as recesses in said lower surface, said lower surface being secured to said actuator member flush with said top wall such that said top wall serves as a fluid seal for the fluidic oscillator recesses.

7. The pump according to claim 1 wherein said housing member including said cup-like configuration and supply tube, is a one-piece molded part; wherein said stem and securing means is a one-piece molded part, and wherein said bulb is a one-piece molded part, wherein said pump includes only three parts.

8. A dispensing pump for dispensing fluid contents from a container, said pump comprising a housing member, a stem and a bulbous elastomer diaphragm which fits into said housing member to define a variable volume pump chamber having a quiescent state wherein the chamber is at maximum volume, said diaphragm and said housing member defining inlet valve means for admitting fluid from said container into said pump chamber during expansion of said pump chamber and blocking flow communication between said pump chamber and said container during contraction of said pump chamber and when said pump chamber is in its quiescent state, said stem and diaphragm defining outlet valve means for expelling fluid to ambient from said chamber during contraction of said pump chamber and blocking communication between said pump chamber and ambient in the quiescent state of said pump chamber and during expansion of said pump chamber, and means for maintaining said bulb in a state of compression within said pump chamber in said quiescent state to positively seal said inlet valve means.

9. The pump according to claim 8 further comprising vent means for providing flow communication between ambient and said container through said housing means, and wherein said bulb includes a convolution formed with said chamber is in said quiescent state which positively seals said vent means to prevent inadvertent spillage of fluid from said container and which unblocks said vent means during contraction and expansion of said pump chamber.

* * * * *